US010214026B1

(12) United States Patent
Jaskowiak et al.

(10) Patent No.: US 10,214,026 B1
(45) Date of Patent: Feb. 26, 2019

(54) SYSTEM AND METHOD FOR ROTATING A THREE-DIMENSIONAL (3D) OBJECT DURING PRINTING OF THE OBJECT

(71) Applicant: Xerox Corporation, Norwalk, CT (US)

(72) Inventors: Timothy R. Jaskowiak, Webster, NY (US); Chu-Heng Liu, Penfield, NY (US); Paul J. McConville, Webser, NY (US); Jason M. LeFevre, Penfield, NY (US); Douglas K. Herrmann, Webster, NY (US); Reid W. Gunnell, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 16 days.

(21) Appl. No.: 15/674,764

(22) Filed: Aug. 11, 2017

(51) Int. Cl.
*B41J 29/00* (2006.01)
*B41J 3/407* (2006.01)

(52) U.S. Cl.
CPC ..... *B41J 3/4073* (2013.01); *B41J 29/00* (2013.01)

(58) Field of Classification Search
CPC ..... B41J 3/4073; B41J 29/00; B41M 5/035
See application file for complete search history.

(56) References Cited

U.S. PATENT DOCUMENTS

| | | | | |
|---|---|---|---|---|
| 6,135,654 | A | 10/2000 | Jennel | |
| 6,360,656 | B2 | 3/2002 | Kubo et al. | |
| 6,923,115 | B1 | 8/2005 | Litscher et al. | |
| 7,120,300 | B1 | 10/2006 | Sankar | |
| 7,736,713 | B2 | 6/2010 | Uptergrove | |
| 7,765,931 | B2 | 8/2010 | Kennedy, III et al. | |
| 8,372,726 | B2 | 2/2013 | de Graff et al. | |
| 8,931,864 | B2 * | 1/2015 | LaCaze | B41J 11/002 198/689.1 |
| 8,978,552 | B2 * | 3/2015 | Preckel | B41J 3/4073 101/171 |
| 9,114,282 | B2 | 8/2015 | Kennedy, III | |
| 9,221,275 | B2 * | 12/2015 | Till | B41J 2/06 |
| 9,302,506 | B2 | 4/2016 | Uptergrove et al. | |
| 9,333,741 | B2 | 5/2016 | Nick et al. | |
| 2002/0097280 | A1 | 7/2002 | Loper et al. | |
| 2005/0178279 | A1 * | 8/2005 | Valls | B41J 3/4073 101/38.1 |
| 2006/0144261 | A1 * | 7/2006 | Uptergrove | B41J 3/4073 101/35 |
| 2009/0169719 | A1 | 7/2009 | Orr | |
| 2009/0256897 | A1 | 10/2009 | Polk et al. | |
| 2011/0012952 | A1 | 1/2011 | Chang et al. | |

(Continued)

FOREIGN PATENT DOCUMENTS

| | | |
|---|---|---|
| EP | 2 591 917 A1 | 5/2013 |
| WO | 2004/016438 A1 | 2/2004 |

*Primary Examiner* — Julian D Huffman
*Assistant Examiner* — Michael T Konczal
(74) *Attorney, Agent, or Firm* — Maginot Moore & Beck LLP

(57) ABSTRACT

A direct-to-object printer includes an object rotating subsystem. The object rotating subsystem includes an actuator with an output shaft, a holder mounted to the output shaft, the holder being configured to grip a portion of the object, and a controller operatively connected to the actuator. The controller is configured to operate the actuator to rotate the holder and the object gripped by the holder to enable at least one of the printheads in a printer to print a portion of a circumference of the object that is longer than a width of the at least one printhead.

20 Claims, 5 Drawing Sheets

(56) References Cited

U.S. PATENT DOCUMENTS

| | | | | |
|---|---|---|---|---|
| 2014/0208699 | A1* | 7/2014 | Reiniger ..... | B41J 3/4073<br>53/510 |
| 2016/0052147 | A1 | 2/2016 | Spicer et al. | |
| 2017/0046548 | A1 | 2/2017 | Kamijo et al. | |

* cited by examiner

SYSTEM AND METHOD FOR ROTATING A THREE-DIMENSIONAL (3D) OBJECT DURING PRINTING OF THE OBJECT

TECHNICAL FIELD

This disclosure relates generally to a system for printing on three-dimensional (3D) objects, and more particularly, to systems that print on cylindrical or other rounded objects.

BACKGROUND

Commercial article printing typically occurs during the production of the article. For example, ball skins are printed with patterns or logos prior to the ball being completed and inflated. Consequently, a non-production establishment, such as a distribution site or retail store, for example, in a region in which potential product customers support multiple professional or collegiate teams, needs to keep an inventory of products bearing the logos of various teams popular in the area. Ordering the correct number of products for each different logo to maintain the inventory can be problematic.

One way to address these issues in non-production outlets is to keep unprinted versions of the products, and print the patterns or logos on them at the distribution site or retail store. Printers known as direct-to-object (DTO) printers have been developed for printing individual objects. These DTO printers have a plurality of printheads that are typically arranged in a vertical configuration with one printhead over another printhead. These printheads are fixed in orientation. When the objects to be printed are rounded, such as balls, water bottles, and the like, a complete image cannot be printed on the surface because the rounded surface falls away from the planar face of the printheads. Enabling DTO printers to be able to print images on all or a portion of the circumference of a rounded object would be beneficial.

SUMMARY

A new three-dimensional (3D) object printing system enables most or all of the circumference of rounded objects to be printed. The printing system includes at least one printhead, the at least one printhead being configured to eject marking material, an object rotating subsystem configured to hold an object and to move the object past the at least one printhead to receive marking material ejected from the at least one printhead. The object rotating subsystem has a first actuator, a chuck operatively connected to the first actuator, the chuck being configured to grip a portion of the object, and a controller operatively connected to the first actuator. The controller is configured to operate the first actuator to rotate the chuck and the object gripped by the chuck to enable the at least one printhead to print a portion of a circumference of the object that is longer than a width of the at least one printhead.

An object rotating subsystem enables most or all of the circumference of rounded objects to be printed in DTO printers. The object rotating subsystem includes a first actuator, a chuck connected to the first actuator, the chuck being configured to grip a portion of the object, and a controller operatively connected to the first actuator. The controller is configured to operate the first actuator to rotate the chuck and the object gripped by the chuck to enable at least one of the printheads to print a portion of a circumference of the object that is longer than a width of the at least one printhead.

BRIEF DESCRIPTION OF THE DRAWINGS

The foregoing aspects and other features of a printing system and an object rotating subsystem that enables most or all of the circumference of rounded objects to be printed are explained in the following description, taken in connection with the accompanying drawings.

DETAILED DESCRIPTION

Figure 1A:
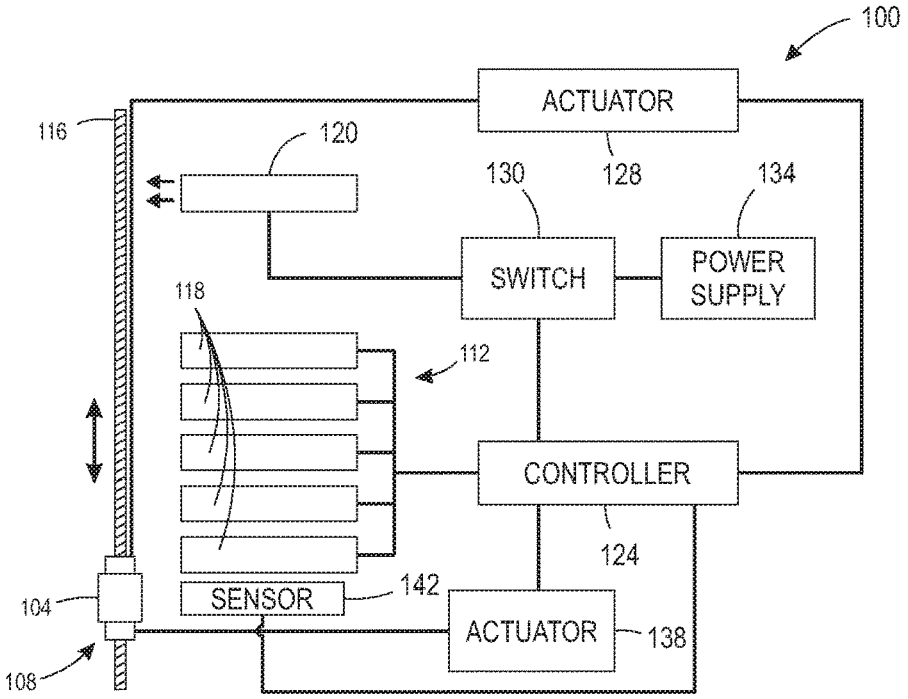
FIG. 1A is a schematic diagram of a side view of a DTO printing system having an object rotating subsystem that enables most or all of the circumference of rounded objects to be printed.

For a general understanding of the present embodiments, reference is made to the drawings. In the drawings, like reference numerals have been used throughout to designate like elements.

FIG. 1A depicts a side view of a direct-to-object (DTO) printing system 100 configured to print the surface of an object 104 secured within an object rotating subsystem 108 as the subsystem 108 moves the object 104 past an array 112 of printheads 118. As used in this document, the word "printhead" means a component having a plurality of ejectors configured to eject marking material. The marking material ejected by an ejector is dependent upon the marking material source to which the ejector is fluidically connected. The object rotating subsystem 108 slides bidirectionally along member 116 as indicated by the arrow in the figure. The controller 124 is configured to operate the actuator 128 to move the object rotating system 108 after the object 104 is mounted into the subsystem 108. Controller 124 is also operatively connected to an actuator 138 that is configured to move either the subsystem 108, the printhead array 112, or both for movement towards and away from one another. A distance sensor 142 is associated with the printhead array 112. The sensor 142 is configured to generate signals corresponding to a distance between the printhead array 112 and the object 104 when the object 104 is opposite the printhead array. The controller 124 receives these signals and operates the actuator 138 to move the printhead array 112 or the subsystem 108 or both relative to one another. Controller 124 is also configured to operate the printheads 118 in the array 112 to eject marking material onto the surface of the object 104. If one or more of the printheads 118 in the array 112 ejects ultraviolet (UV) marking material, then the UV curing device 120 is operated by controller 124 to cure the UV material. As used in this document, "UV light" refers to light having a wavelength that is shorter than visible light, but longer than X-rays. The wavelength of such light is about 10 nm to about 400 nm.

Figure 1B:
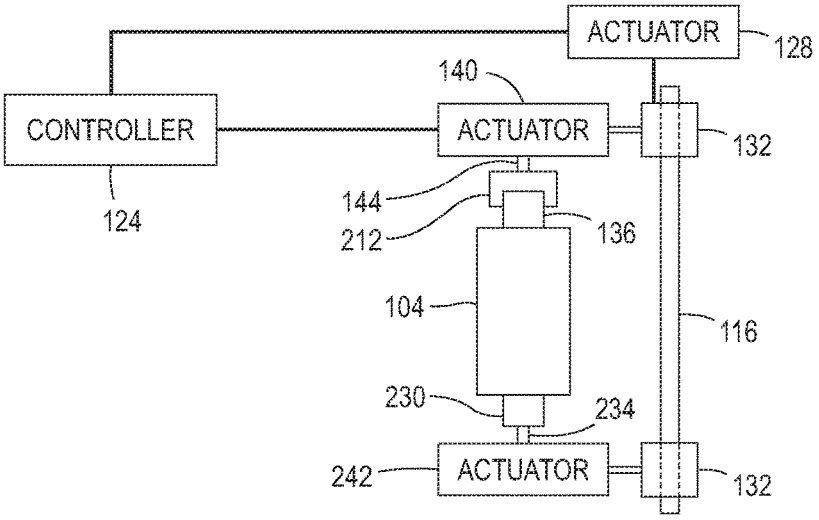
FIG. 1B is a schematic diagram of a view of the object rotating subsystem of FIG. 1A from a printhead ejecting material onto the object held by the subsystem.

One embodiment of the subsystem 108 is shown from the perspective of being opposite a printhead in FIG. 1B. Subsystem 108 includes a pair of sleeves 132 that receive the member 116. At least one of the sleeves 132 is operatively connected to the actuator 128 so the controller 124 can operate the actuator 128 to move the subsystem 108 along the member 116 bidirectionally. This bidirectional movement is called movement in a process direction. The configuration shown in the figure offsets the actuators 140 and 242 from the member 116. The printheads 118 are offset in the cross-process direction from the longitudinal axis of the member 116 to enable the printheads to eject marking material towards the object 104 held by the subsystem 108. Likewise, the UV curing device 120 is offset in the cross-process direction to enable the UV curing device to direct UV light toward the image on the object 104 to cure UV curable material on the object. Actuator 140 is mechanically connected to one of the sleeves 132 and is operatively connected to the controller 124. A holder 212 is mounted to the output shaft 144 of the actuator 140. The holder 212 is configured to grip and hold a portion 136 of the object 104 as the actuator 140 is operated by the controller 124 to rotate the object 104 as explained in more detail below. An extension 230 rotatably mounted to the output shaft 234 of the actuator 242 supports the bottom of the object 104. The actuator 242 is connected to a sleeve 132 and the actuator 242 displaces its output shaft 234 toward and away from the object 104 to enable an object 104 to be installed and removed from the object rotating subsystem 108 as explained more fully below.

Figure 2:
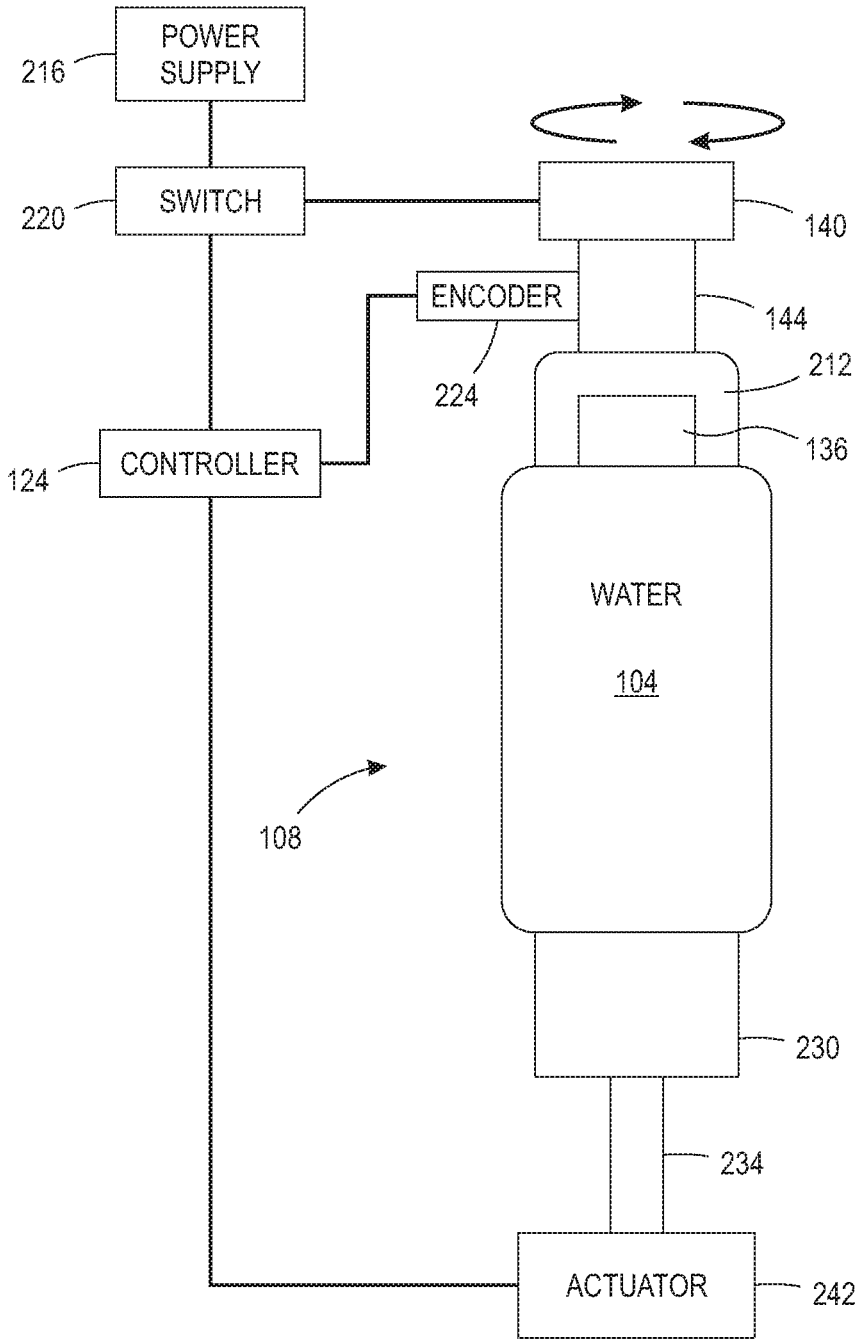
FIG. 2 depicts an embodiment of the object rotating subsystem used in the printing system of FIG. 1.

FIG. 2 is an illustration of an embodiment of the object rotating subsystem 108 that can be used in the printing system 100. As used in this document, the word "subsystem" refers to two or more components that are operated to perform a particular function within a larger system. Although not depicted in FIG. 2, the controller 124 operates the actuator 128 to move the sleeves 132 and the subsystem 108 past the printhead array 112 and the UV curing device 120 in the process direction as noted above with reference to FIG. 1B. As shown in FIG. 1B and FIG. 2, the actuator 140 of subsystem 108 can be an electrical motor having an output shaft 144 on which a holder 212 is mounted. FIG. 2 further depicts the actuator 140 being electrically connected to an electrical power source 216 through an electrical switch 220. The controller 124 is operatively connected to the electrical switch 220 to enable the controller to operate the switch 220 and selectively connect the actuator 140 to electrical power. Once at least a portion 136 of an object 104 is secured within the holder 212, the controller 124 can operate the actuator 140 through the switch 220 to rotate the object. As the object rotating subsystem 108 moves past the printheads 118 in the array 112 (FIG. 1A), rotation of the object enables a portion or the entire circumference of the object to be printed by one or more of the printheads. In one embodiment shown in FIG. 2, a rotary encoder 224 is positioned next to the output shaft of the actuator 140 to enable the controller 124 to receive an electrical signal generated by the encoder that indicates the position of the shaft 144. The controller 124 is configured with software that enables the controller to process the electrical signals from the encoder 224 and identify the portion of a circumference of the object 104 that faces a printhead 118 so a portion of an image can be printed on the object. In an alternative embodiment, the actuator 140 is a stepper motor and the controller 124 identifies the position of the object grasped by the holder 212 with reference to the pulses sent to the actuator to rotate the holder and the object. In this embodiment, an encoder is not required to enable the controller to identify the portion of the object surface facing the printheads.

The holder 212 can be a known collet chuck, a three-jaw chuck, a collar configured to grip structure located at an extremity of an object to be printed, a granular material holder, or the like. As used in this document, the word "holder" means any device configured to secure an object to be printed. As used in this document, the words "collar" and "chuck" mean a planar member having an opening and at least one movable member that varies the size of the opening to secure selectively an object with a predetermined orientation. A chuck can rotate in a first direction to advance the at least one movable member of the chuck into the opening within the chuck to secure an object in a known manner. Reversing the rotation of the chuck releases the object from the collar. In another embodiment of a chuck, the movable members of the chuck come together at the center of the opening within the chuck and rotation of the chuck in the first direction moves the members toward the circumference of the opening so the members can be inserted into an opening of an object, such as the mouth of a bottle, and the rotation in the first direction urges the members against the circumference of the object opening to hold the object for printing. Reversing the rotation of the chuck brings the members together in the center of the opening to reduce the pressure against the circumference of the object opening so the object can be removed. As used in this document, the term "granular material holder" means a pliable container filled with granular material that has its interior fluidically connected to an air evacuation and air pressurization source to enable air between grains for the granular material to be removed to secure a portion of an object deforming the container and to urge air between grains to release the object portion.

As shown in FIG. 2, the output shaft 234 of the actuator 242 in the object rotating subsystem 108 includes an extension 230 that engages the bottom of the object 104. The extension 230 is rotatably mounted to the output shaft 234 by a bearing or the like. As the actuator 140 rotates the object 104, the extension 230 rotates about the output shaft 234 to enable the object to rotate. The output shaft 234 is operatively connected to actuator 242, which is configured to move the output shaft 234 bidirectionally in the vertical direction. The controller 124, which is operatively connected to the actuator 242, operates the actuator 242 to move the extension 230 to a position where extension 230 engages a bottom surface of the object 104 held at its other end by the holder 212. In this position, the extension 230 helps support the object 104 during printing and while it rotates freely as the actuator 140 turns the output shaft 144 and the object 104. The operation of the actuator 242 varies the distance between the extension 230 and the holder 212 to accommodate objects of different lengths. Once printing of the object is completed and the subsystem 108 returns to its starting position, the holder 212 is operated to release one end of the object 104 and the actuator 242 is operated to lower the extension 230 so the object 104 can be retrieved from the subsystem 108.

A process for operating the printer 100 is shown in FIG. 3. In the description of the process, statements that the process is performing some task or function refers to a controller or general purpose processor executing programmed instructions stored in non-transitory computer readable storage media operatively connected to the controller or processor to manipulate data or to operate one or more components in the printer to perform the task or function. The controller 124 noted above can be such a controller or processor. Alternatively, the controller can be implemented with more than one processor and associated circuitry and components, each of which is configured to form one or more tasks or functions described herein. Additionally, the steps of the method may be performed in any feasible chronological order, regardless of the order shown in the figures or the order in which the processing is described.

Figure 3A:
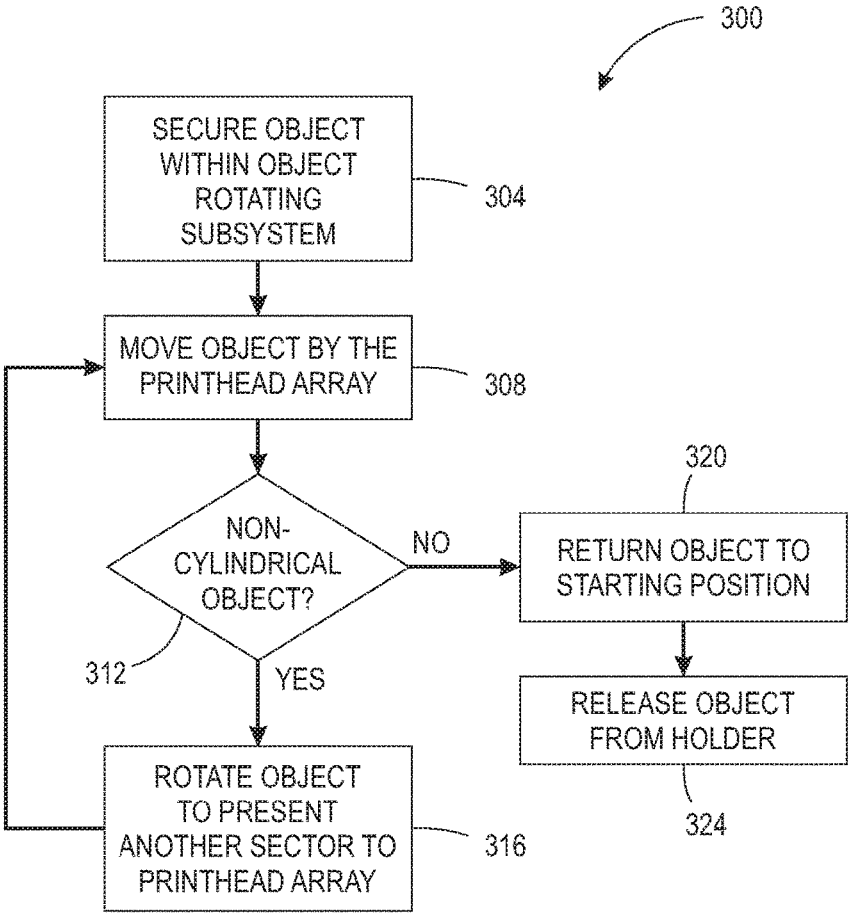
FIG. 3A depicts a process for operating the printer of FIG. 1 that rotates an object held by the object rotating subsystem.

FIG. 3A is a flow diagram of a process that implements the rotating of the object being printed described above with either embodiment of the rotating object subsystem 108. The process 300 begins with the holder 212 being operated to secure the object 104 in the subsystem 108 and the actuator 242 being operated to support the bottom of the object with the extension 230 (block 304). The controller 124 operates the actuator 128 to move the object 104 by the printheads 118 in the array 112 as the controller operates the printeheads to print the sector of the object facing the printheads (block 308). If another sector of the object is to be printed (block 312), then the controller 124 operates the actuator 140 to rotate the object 104 after the object has past the last printhead 118 in the array 112 to the next sector to be printed (block 316). The controller 124 operates the actuator 128 to move the object by the printheads 118 in the opposite direction so the printheads can print the sector facing the printheads (block 312). This process of rotating the object and then passing the object past the printheads continues until all of the sectors on the object circumference that need printing are printed. At that time, the controller 124 operates the actuator 128 to return the object to its starting position (block 320), where it can be released from the holder 212 (block 324).

Figure 3B:
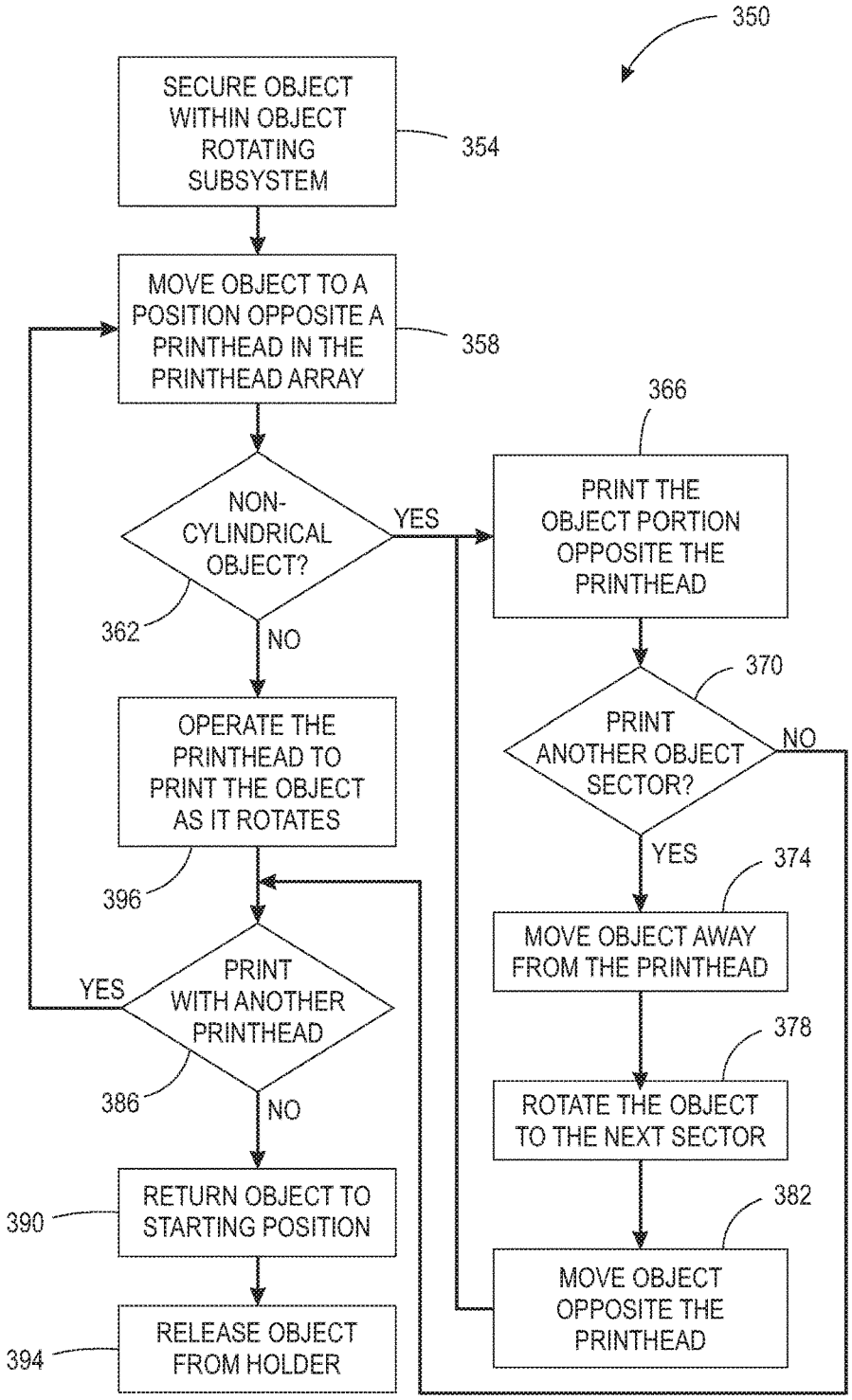
FIG. 3B depicts an alternative process for operating the printer of FIG. 1 that rotates an object held by the object rotating subsystem.

A flow diagram of an alternative process that implements the printing of an object held by either embodiment of the rotating object subsystem 108 is shown in FIG. 3B. The process 350 begins with the holder 212 being operated to secure the object 104 in the subsystem 108 and the actuator 242 being operated to support the bottom of the object with the extension 230 (block 354). The controller 124 operates actuator 128 to stop the object opposite one of the printheads 118 in the array 112 (block 358). An operator can enter data identifying the object configuration prior to the printing of the object. When the object is non-cylindrical (block 362), the object sector opposite the printhead is printed (block 366) and the process determines whether another object sector is to be printed (block 370). The printing performed by the processing in block 366 can include moving the object vertically by a small increment to print the sector if the vertical height of the image is greater than the height of the ejector array in the printhead currently being used to print the sector. If another sector is to be printed, the controller 124 operates the actuator 138 to move the array 112, the subsystem 108, or both relative to one another with reference to the signals from sensor 142 prior to rotating the object (block 374). Once the object and array have been separated by an appropriate distance to enable rotation of the object without striking the array, the object is rotated (block 378) and the object returned to a distance appropriate for printing another sector of the non-cylindrical object by controller 124 operating actuator 138 (block 382). This sector is printed (block 366) and the process continues until all of the sectors for the object circumference opposite the printhead are printed (block 370). When all of the sectors of the current perimeter are printed, the process determines whether the perimeter is to be printed with another printhead (block 386). If it is, then the processing of blocks 358 to 382 is repeated to print the perimeter with another printhead. Once the perimeter has been printed by all of the printheads, the object is returned to its starting position (block 390) and released from the holder (block 394). If the object is cylindrical, then it can be rotated without striking the printheads. In this situation, the first printhead at which the object stopped is operated to print the circumference as the object is rotated (block 396). The printing performed by the processing in block 396 can include moving the object vertically by a small increment to print the sector if the vertical height of the image is greater than the height of the ejector array in the printhead currently being used to print the sector. If the circumference is to be printed with another printhead (block 386), the object is moved opposite the printhead (block 358) and rotated while being printed with the printhead (block 396). This process continues until all of the printheads have printed the circumference. At that time, the object is returned to its starting position (block 390) and released from the holder (block 394).

Figure 4:
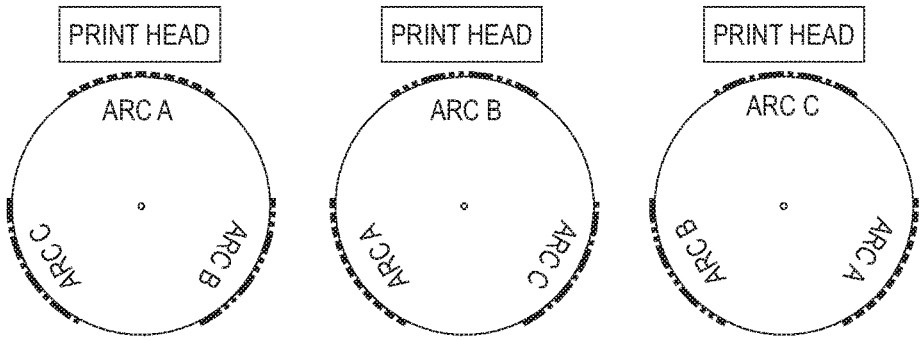
FIG. 4 depicts printing of discontinuous sectors of the circumference of the object held by the object rotating subsystem shown in FIG. 1A.
Figure 5:
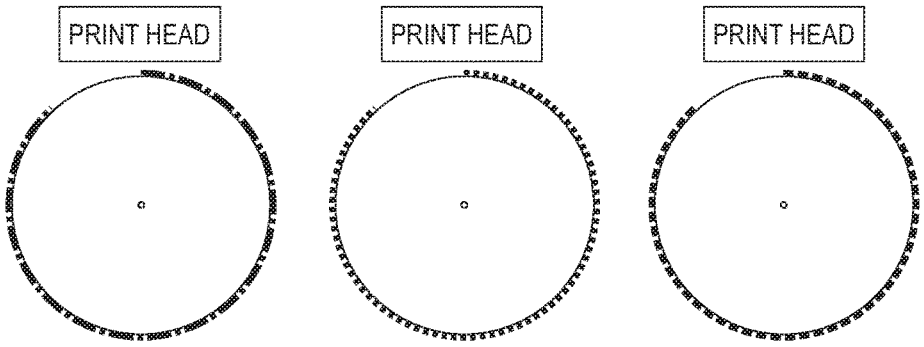
FIG. 5 depicts continuous printing of the circumference of the object held by the object rotating subsystem shown in FIG. 1A.

The rotation of the object 104 in the processes of FIG. 3A and FIG. 3B can present another portion of the circumference or perimeter for printing that is separated from the first printed portion by a predetermined distance, as depicted in FIG. 4. Thus, different sectors of a circumference or perimeter of the object can be printed, to avoid a protrusion or depression in the surface such as a handle, Cylindrical objects can be rotated by the process in FIG. 3B at block 396 to enable printing of a continuous image around all or most of the circumference of the object 104, as depicted in FIG. 5. In the process of FIG. 3A, the rotation of the object that occurs after the object has passed the printhead array can either present non-contiguous sectors for printing or continuous sectors for printing regardless of the configuration of the object.

It will be appreciated that variations of the above-disclosed apparatus and other features, and functions, or alternatives thereof, may be desirably combined into many other different systems or applications. For example, while the embodiments described above have been illustrated with a vertical configuration, the printing system and the object rotating subsystem can be configured for moving an object through a printer in other directions. Various presently unforeseen or unanticipated alternatives, modifications, variations, or improvements therein may be subsequently made by those skilled in the art, which are also intended to be encompassed by the following claims.

What is claimed is:

1. A printing system comprising:

at least one printhead, the at least one printhead being configured to eject drops of marking material;

a member having a first end and a second end, the first end of the member being at a greater gravitational potential than the second end and the at least one printhead being positioned opposite the member and between the first and second ends of the member;

an object rotating subsystem configured to hold an object and to move along the member between the first end and the second end to carry the object past the at least one printhead to enable the at least one printhead to eject drops of marking material onto the object, the object rotating subsystem having:

a first actuator;

a holder operatively connected to the first actuator, the holder being configured to grip a portion of the object;

a second actuator having an output shaft;

an extension rotatably mounted to the output shaft of the second actuator, the extension being configured to support a planar surface of the object at an end of the object opposite the portion of the object gripped by the holder; and a controller operatively connected to the first actuator and the second actuator, the controller being configured to operate the first actuator to rotate the holder and the object gripped by the holder to enable the at least one printhead to print a portion of a circumference of the object that is longer than a width of the at least one printhead and to operate the second actuator to extend the output shaft of the second actuator to move the extension into engagement with the planar surface of the end of the object opposite the portion of the object gripped by the holder and to retract the output shaft of the second actuator to support the object and move the object away from the holder after the holder releases the object.

2. The printing system of claim 1 wherein the holder is a chuck.

3. The printing system of claim 1 wherein the first actuator connected to the holder is a stepper motor.

4. The printing system of claim 3, the object rotating subsystem further comprising:

a rotary encoder configured to generate an electrical signal indicative of an angular displacement of an output shaft of the first actuator; and the controller is further configured to process the electrical signals generated by the rotary encoder to identify a position of a surface of the object.

5. The printing system of claim 4, the object rotating subsystem further comprising:

an electrical power source;

an electrical switch operatively connected to the electrical power source and the first actuator; and the controller is operatively connected to the electrical switch, the controller being further configured to operate the electrical switch to connect the electrical power source to the first actuator selectively.

6. The printing system of claim 5 further comprising:

a third actuator operatively connected to the object rotating subsystem; and the controller is operatively connected to the third actuator, the controller is further configured to operate the third actuator connected to the object rotating subsystem to move the object rotating subsystem in a bidirectional process direction along the member.

7. The printing system of claim 6 further comprising:

a fourth actuator operatively connected to the at least one printhead, the fourth actuator being configured to move the at least one printhead toward and away from the object gripped by the holder of the object rotating system; and the controller is operatively connected to the fourth actuator, the controller is further configured to operate the fourth actuator to move the at least one printhead toward and away from the object gripped by the holder of the object rotating subsystem.

8. The printing system of claim 7 further comprising:

a sensor configured to generate signals corresponding to a distance between the at least one printhead and the object gripped by the holder of the object rotating subsystem when the object rotating subsystem is positioned opposite the at least one printhead; and the controller is operatively connected to the sensor, the controller is further configured to operate the fourth actuator to move the at least one printhead toward and away from the object gripped by the holder of the object rotating subsystem with reference to the signals received from the sensor.

9. The printing system of claim 1, the controller being further configured to rotate the holder and the object gripped by the holder to enable the at least one printhead to eject marking material onto at least two portions of the circumference of the object that are separated by a predetermined distance, the two portions and the predetermined distance together being greater than a width of the at least one printhead.

10. The printing system of claim 1, the controller being further configured to rotate the holder and the object gripped by the holder to enable the at least one printhead to eject marking material onto a continuous portion of the circumference of the object that is at least greater in distance than a width of the at least one printhead and up to a distance as long as a complete revolution of the object.

11. An object rotating subsystem configured to hold an object and to move the object past a plurality of printheads to receive marking material ejected from the printheads, the object rotating subsystem comprising:

a first actuator;

a member having a first end and a second end, the first end of the member being at a greater gravitational potential than the second end;

a holder connected to the first actuator, the holder being configured to grip a portion of the object and to move between the first and the second ends of the member;

a second actuator having an output shaft;

an extension rotatably mounted to the output shaft of the second actuator, the extension being configured to support a planar surface of the object at an end of the object opposite the portion of the object gripped by the holder; and a controller operatively connected to the first actuator and the second actuator, the controller being configured to operate the first actuator to rotate the holder and the object gripped by the holder to enable at least one of the printheads to print a portion of a circumference of the object that is longer than a width of the at least one printhead and to operate the second actuator to extend the output shaft of the second actuator to move the extension into engagement with the planar surface of the end of the object opposite the portion of the object gripped by the holder and to retract the output shaft of the second actuator to support the object and move the object away from the holder after the holder releases the object.

12. The object rotating subsystem of claim 11 wherein the holder is a chuck.

13. The object rotating subsystem of claim 11 wherein the first actuator is a stepper motor.

14. The object rotating subsystem of claim 11 further comprising:

a rotary encoder configured to generate an electrical signal indicative of an angular displacement of an output shaft of the first actuator; and the controller is further configured to process the electrical signals generated by the rotary encoder to identify a position of a surface of the object.

15. The object rotating subsystem of claim 14 further comprising:

an electrical power source;

an electrical switch operatively connected to the electrical power source and the first actuator; and the controller is operatively connected to the electrical switch, the controller being further configured to operate the electrical switch to connect the electrical power source to the first actuator selectively.

16. The object rotating subsystem of claim 15 further comprising:

a third actuator operatively connected to the object rotating subsystem; and the controller is operatively connected to the third actuator connected to the object rotating subsystem, the controller is further configured to operate the third actuator connected to the object rotating subsystem to move the object rotating subsystem in a bidirectional process direction.

17. The object rotating subsystem of claim 16 further comprising:

a fourth actuator operatively connected to the at least one printhead, the fourth actuator being configured to move the at least one printhead toward and away from the object gripped by the holder of the object rotating system; and the controller is operatively connected to the fourth actuator, the controller is further configured to operate the fourth actuator to move the at least one printhead toward and away from the object gripped by the holder of the object rotating subsystem.

18. The printing system of claim 17 further comprising:

a sensor configured to generate signals corresponding to a distance between the at least one printhead and the object gripped by the holder of the object rotating subsystem when the object rotating subsystem is positioned opposite the at least one printhead; and the controller is operatively connected to the sensor, the controller is further configured to operate the fourth actuator to move the at least one printhead toward and away from the object gripped by the holder of the object rotating subsystem with reference to the signals received from the sensor.

19. The object rotating subsystem of claim 11, the controller being further configured to rotate the holder and the object gripped by the holder to enable the at least one printhead to eject marking material onto at least two portions of the circumference of the object that are separated by a predetermined distance, the two portions and the predetermined distance together being greater than a width of the at least one printhead.

20. The object rotating subsystem of claim 11, the controller being further configured to rotate the holder and the object gripped by the holder to enable the at least one printhead to eject marking material onto a continuous portion of the circumference of the object that is at least greater in distance than a width of the at least one printhead and up to a distance as long as a complete revolution of the object.

* * * * *